United States Patent [19]

Raisch

[11] 4,427,315

[45] Jan. 24, 1984

[54] DEVICE FOR THE REMOVAL OF PAPER FROM BINDERS

[76] Inventor: Arthur Raisch, Hans-Sachs-Straase 8, 7250 Leonberg-Eltingen, Fed. Rep. of Germany

[21] Appl. No.: 236,617

[22] Filed: Feb. 20, 1981

[30] Foreign Application Priority Data

Feb. 22, 1980 [DE] Fed. Rep. of Germany ..... 3006606

[51] Int. Cl.[3] ..... B42F 3/00

[52] U.S. Cl. ..... 402/80 R; 227/156; 402/7

[58] Field of Search ..... 227/156; 402/7, 24, 402/25, 80 R

[56] References Cited

U.S. PATENT DOCUMENTS 1,546,183 7/1925 Wirt ..... 402/80 R

FOREIGN PATENT DOCUMENTS 365295 1/1932 United Kingdom .
785206 10/1957 United Kingdom ..... 402/80 R
1139754 1/1969 United Kingdom .
2035215 6/1980 United Kingdom ..... 402/80 R

*Primary Examiner*—Paul A. Bell

[57] ABSTRACT

The device is used to remove two-hole sheets from a binder which has flat, thin bendable prongs for holding the sheets. It is a U-shaped handle device, formed by legs at each end of a crosspiece. The cross-section of the legs at their free ends are smaller than the diameter of the sheet holes. The free ends have a longitudinal recess, open to the outside, and shaped to receive the free end of the binder prongs.

17 Claims, 8 Drawing Figures

DEVICE FOR THE REMOVAL OF PAPER FROM BINDERS

Figure 1:
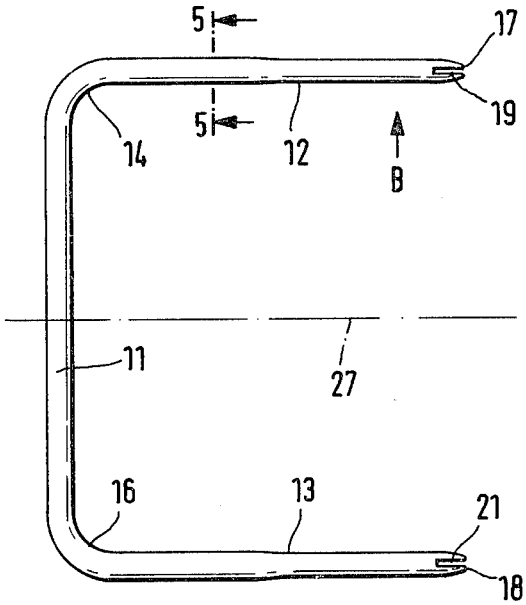

Most binders, e.g., for a hanging file system, have two narrow prongs. These usually consist of sheet metal or of plastic. They are flexible. When in use, they pass with a first section through the marginal punched holes of the binders. To the extent that the prongs project beyond the marginal punched holes, the prongs are bent off at a 90° angle. If the prongs are made of metal, the stiffness inherent in the metal will suffice to hold the paper in place at its left margin. In many binders however, a metal clip is additionally slipped onto the uppermost sheet over the prongs and this metal clip then serves as both the distance gage and a device to keep the sheets in place.

If the prongs are made of plastic, they naturally try to maintain their straight position. For such cases, but also for more complicated binders of this type, the metal clip is more intricately designed and has a mechanism that holds the bent-off areas of the prongs in place.

The bending point in the prongs travels outward as the file expands. In contrast to binders with a lever mechanism, binders of this type adjust their volume to the growing volume whereas a binder with lever mechanism almost always retains the same volume, regardless of whether it is filled or accommodates only one sheet of paper.

In the case of these binders equipped with prongs it might often become necessary to remove certain sheets. The sheet in question may, for example, be filed underneath 20 other sheets. Removal is necessary, for example, for copying purposes or other work processes.

This invariably entails considerable difficulties: a stack of paper is removed and placed aside, the desired sheet or sheets removed, processed or otherwise applied to the intended purpose; the so-processed sheets are then replaced over the prongs and the removed stack of sheets replaced by their punched holes over the prongs.

Generally, no more than an attempt is made because in the meantime the paper stack has shifted and the punch holes must first be realigned. This is usually accomplished by first inserting the tip of a ballpoint pen into one punched hole set and once this has been so threaded, a second ballpoint tip is worked into the second punched hole set. The ballpoint pen tips are then withdrawn and the punched holes are again placed over the prongs.

Even the procedure just described has its pitfalls because quite often, the sheets are unevenly punched and/or many sheets have only one hole and/or the sheets have different formats, so that the aligning effort becomes futile, and/or the punch hole of the individual sheet is sometimes too close to the upper and sometimes too close to the lower end of the paper.

Everyone is familiar with this dilemma, from childhood to old age.

The task of the invention is to provide a simple device that masks it possible to easily remove the paper stack and easily replace it in the same order.

According to the invention, this task is solved by the following characteristics:

(a) An approximately U-shaped handle device is provided whose crosspiece connects two legs with each other.

(b) In their free end region the largest cross-sectional dimension is similar than the diameter of the punched holes.

(c) The front end of each leg has a longitudinal recess facing outward which is designed so as to receive the free end sections of the prongs.

Advantageously, the invention has the following additional features:

The crosspiece and the legs are rigidly connected with one another and the legs are parallel to each other. Due to these characteristics, these longitudinal recesses—unlike in the case of an elastic connection of crosspiece and leg—always correspond to the space between the prongs and it is not necessary to concern oneself with their alignment.

The legs are of different lengths. Due to these characteristics the prongs can be brought into the recesses one by one rather than simultaneously, which is more difficult. Even a difference of several millimeters will suffice.

The longitudinal recesses have a flat-rectangular cross-section. Due to these characteristics, the prongs can be received in good alignment or if necessary can be properly aligned.

The longer cross-sectional dimension is perpendicular to the longitudinal extension of the handle device. Due to these characteristics, it is unnecessary to first twist the prongs about their longitudinal axis, which would be possible per se. Rather, the natural position of the prongs is utilized.

The end regions of the legs have the shape of an acorn through which passes the mouth of the longitudinal recess. These characteristics make it possible that due to the shape resulting from this penetration, the prongs are pointed but sufficiently resilient, which is particularly advantageous in the case of the plastic version.

The end region of the legs is thinner in the transverse direction to the longitudinal extension of the crosspiece than it is in the perpendicular direction to same. Due to these characteristics, less force is needed to press the device onto the prongs, because in perpendicular direction to the prongs the rims of the holes do not align as well as they do in transverse direction to the prongs. The design of the invention thus requires minimal displacement effort.

Overall it may be said that the invention proves effective whether the paper is thin or thick. The invention is even then effective when the metal prongs are severely bent, such as is usually the case as the file increases in volume since the prongs can be bent in one as well as the other direction and these flexures often remain as permanent deformities. The device according to the invention will in fact even smooth these prongs, making the use of pliers unnecessary which are sometimes employed to straighten extremely misshapen prongs. The removal of sheets is no more of a problem, nor is the task of returning the sheets to their original order. The device can be a one-piece construction and can be inexpensive. It is not a bulky item. It requires no instructions because everyone will understand its operation without having used it. The device takes up minimal space in a drawer and enormously simplifies filing tasks with the least effort. The device can be manufactured of plastic and/or metal. The crosspiece can be used to carry advertising.

In Germany, a binder has been known as belonging to the Leitz archive binder system and carried under order numbers 1 190 to 1 196, part of which is a file transfer device available under order No. 1 785. This system works as follows: The binders for daily filing are relatively expensive because of the metal lever mechanism, the thick cardboard construction, the protective edge for the cardboard, the grip hole in the back of the binder, etc. Once such a rather expensive binder has been filled, its contents are transferred for reasons of economy to a less expensive, so-called archive binder. This binder is in its outer dimensions equal to the binder used on a daily basis, but instead of the lever mechanism it has two small hollow metal tubes which can pass through the marginal punched holes, and to prevent the sheets from sliding off these metal tubes, a C-piece is provided whose legs fit into the small metal tubes and at whose crosspiece a spiral spring is attached, the free bent-off end of which engages in a specially formed hinge-half attached to the inner back of the archive binder. This prevents the sheets from slipping out after they have been transferred.

The transfer device itself consists of three parts: A C-shaped wire device has a ring-shaped grip at its crosspiece. The legs of the wire device are accommodated in small metal tubes similar to the small metal tubes of the archive binder. At their inner end they are connected by a crosspiece. The crosspiece has a detention flap which when the object is in use assures that the tubes always retain the proper position in relation to the wire legs and at the same time, as a third part, it prevents the loss of the two parts.

For the purpose of transfer, the wire legs are brought back as far as possible within the tubes to a distance of approximately ½ cm from the front ends of the tubes.

Next, the lever mechanism is opened. The lever mechanism consists of a movable part and an immovable part. The immovable part in turn consists of two thick rigid rods that pass through the round punched holes. The free end of each of these rods has an arc-shaped bend and each of its upper ends has a nipple-shaped alignment projection, which engages with a correspondingly shaped recess in the movable part of the lever mechanism and in the closed state almost completely eliminates relative motion.

These alignment projections aid in the positioning of the free tube ends of the transfer device. The tubes are placed tangentially onto these arc-shaped bends after the lever mechanism has been opened. The filed sheets are then moved up over the tubes of the transfer device. It is important to assure that the inner edge moves past the movable part of the lever mechanism. The distance between this edge and the free ends is practically zero. In my opinion, this transfer operation requires four hands.

Having thus threaded the sheets onto the tubes, one approaches the archive binder, slides the wire handle far enough forward to allow the wires to project to a certain extent beyond the tubes and, using the projecting wire ends as alignment aids, places the tubes of the transfer device onto the tubes of the archive binder.

The sheets are then allowed to drop over the tubes of the archive binder, the unit is locked from above with the C-clamp and the C-clamp is secured by means of the curve in the spiral spring.

As one can easily see, this procedure including all of its pertinent accessories is in its own field of application barely suitable for practical use, so that it is generally preferred not to take this route of file transfer.

Secondly, the application involves considerable familiarization with detail.

A third point is that this device is anything but an incentive to make a reasonable attempt to overcome the initially presented problems.

The invention shall now be described by means of preferred exemplified embodiments.

Figure 6:
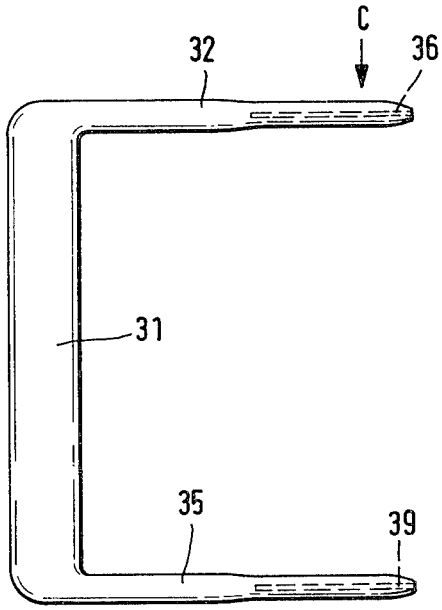
Figure 2:
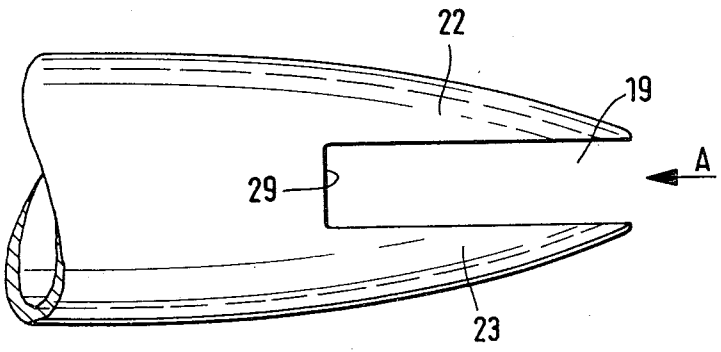
Figure 3:
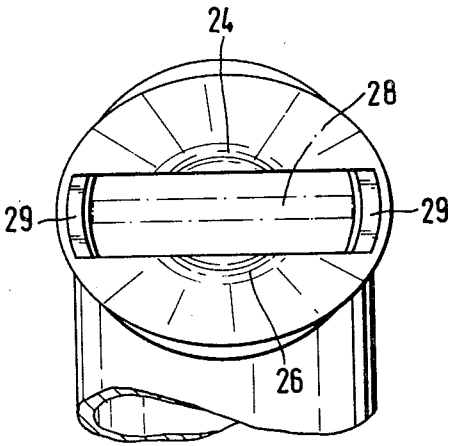
Figure 5:
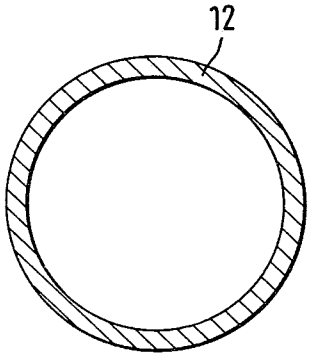
Figure 4:
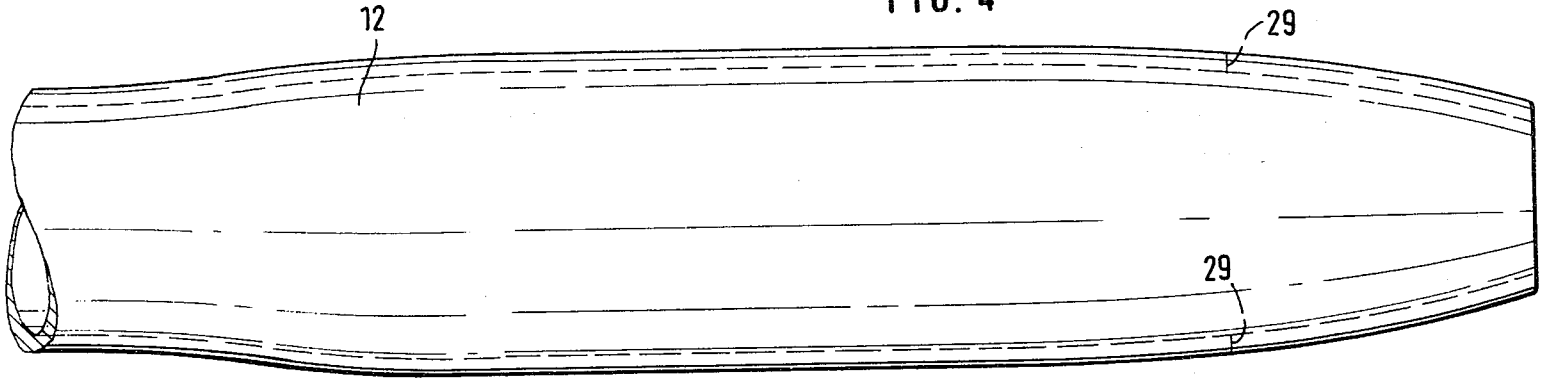
Figure 7:
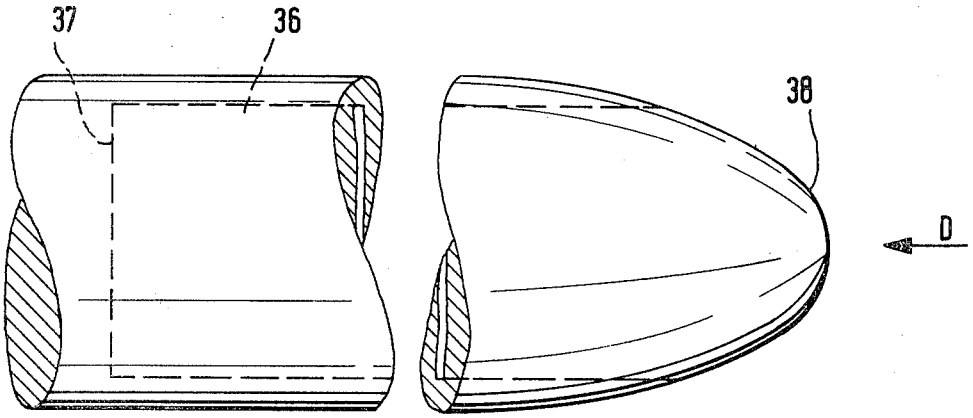
Figure 8:
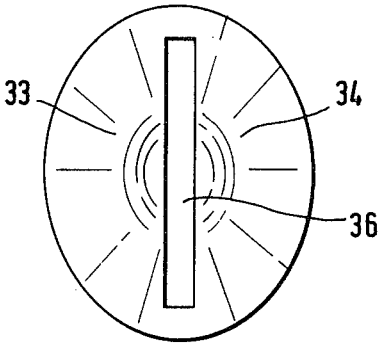

In the drawing:

FIG. 1 shows the side view of a first exemplified embodiment on a 1:1 scale, FIG. 2 is a 10×enlarged representation of the right upper region of FIG. 1, FIG. 3 is a view per arrow A in FIG. 2, FIG. 4 is a view per arrow B in FIG. 1, also as a 10×enlarged representation, FIG. 5 is a section along line 5—5 in FIG. 1, FIG. 6 is a view of a second exemplified embodiment on a scale of 1:1, similar to FIG. 1, FIG. 7 is a 10×enlarged representation of the right upper region of FIG. 6 in direction of arrow C, FIG. 8 is a view of FIG. 7 in direction of arrow D.

A device according to FIG. 1 is designed as a U-shaped handle and has a crosspiece 11, a first leg 12 and a second leg 13. These consist of a nickel-plated metal tube of circular-cylindrical cross section with an outer diameter of 5 mm and a uniform wall thickness of 0.3 mm. The space between the legs is 7.6 cm. Legs 12, 13 are approximately 6 cm long. The U-shaped design is created by bending the originally straight tube, resulting in 90° radii 14 and 16. As shown in FIG. 1 and in the final result also in FIG. 3, the tube, beginning at a distance of approximately 3 cm—measured from the free ends of legs 12, 13—is flattened to a permanently deformed state. It is by no means necessary to shape it, for example, into an exact oval or an exact ellipse. Approximately at the point where the arrow of B ends in FIG. 1, the tube in the diagram plane measures about 4.4 mm whereas the measurement perpendicular to the plane—as also seen in FIG. 4—is 5.4 mm.

In the direction from end faces 17 and 18 perpendicular to the diagram plane of FIG. 1, i.e. perpendicular to the longitudinal extension of crosspiece 11, a slot 19, 21 is cut which, seen in the diagram plane of FIG. 2, is 1.4 mm wide and 5 mm deep. This creates the mouth, and the upper mouth section 22 and the lower mouth section 23 are, as shown in FIG. 2 in overproportion, again pressed together (in overproportion in relation to the longer, but also pressed-together areas seen in FIG. 1), so that in FIG. 3 the distance between points 24 and 26 is 2.5 mm. The two end regions of legs 12, 13 represent a mirror image in relation to median plane 27, for which reason only one has been described. The burrs resulting from creating slots 19, 21 can be removed by placing the device into a polishing drum.

FIG. 3 shows prong 28 of a binder in broken lines. Such prongs are 0.3 mm thick and 4.5 mm wide. They fit easily into the punched holes of sheets that have a 5.5 mm diameter. Legs 12, 13 have this 5.5 mm dimension in the area of their free ends immediately behind base 29 of slots 19, 21, but do not have nearly this measurement in the direction seen in FIG. 2 in which, of course, the punched holes of the sheets because of the flat rectangular shape 28 are arranged in a much less orderly fashion.

Penetration of slot 19, 21, and upper mouth part 22 and lower mouth part 23, create a rounded-off, conical or acron-shaped contour which simplifies passage through the punched holes of the sheets.

Prongs 28 are usually pointed at their ends as well, so that it is very easy to place them and insert them into slots 19, 21.

To use the device, the prongs of the binders are straightened, the metal retainer clip is removed and the transfer device is slipped on in such a way that prongs 28 align with slots 19, 21. Then, legs 12, 13 are further pressed into the file, up to a point deemed necessary. The papers filed on top of the needed sheet are picked up, and the unit transfer device/paper stack removed. This unit may then be placed aside, possibly with legs 12, 13 facing upwards; the desired sheet is removed for such purposes as copying, for example, after which the sheet is replaced over the prongs of the binder. The unit transfer device/paper stack is now retrieved, prongs 28 inserted into legs 12, 13 and the paper stack is allowed to slide back down.

This can be done by one person with two hands and without instruction. When the operation is completed the paper stack is guaranteed to be in the same order in the file as before.

The exemplified embodiment is a one-piece unit. It is safe. It weighs only 19 grams, the amount of material used is negligible. The necessary raw materials are readily available as they are industrially used for other purposes. No special skills are required in the manufacture, and simple manufacturing methods are easily conceived.

The second exemplified embodiment is injection-molded. Its crosspiece 31 is wide enough to conveniently fit the hand. Its legs 32, 35 have the same outer shape as do legs 12, 13. The same applies to upper mouth part 33 and lower mouth part 34.

A slot 36 of rectangular, flat cross section extends to its bottom 37 at a distance of 28 mm from tip 38 of the mouth. This is entirely satisfactory because it is not absolutely necessary that legs 32, 35 accommodate prongs 28 in their entirety. Overlapping by 1 to 3 cm is completely sufficient. Here, slots 36, 39 form blind holes which according to FIG. 8 are surrounded by walls of adequate thickness so as to prevent buckling or tearing.

Should the binders have 3 prongs instead of 2 prongs, then a third leg is to be provided at the appropriate location. Two legs are actually sufficient as long as all sheets have at least 2 punch holes in common.

I claim:

1. Device for the removal of sheets that have two circular marginal punched holes, from a binder which has flexible, thin prongs that have a flat shaped cross section and are bendable in an easy bending direction, comprising:

(a) an approximately U-shaped tubular handle having a tubular crosspiece and two tubular legs with free end regions, connected with one another by the crosspiece, (b) in their free region, the largest cross-sectional dimension of the two legs is smaller than the diameter of the circular marginal punched holes, (c) in the free ends of the legs a longitudinal recess is provided that is open to the outside, which is shaped so as to receive the free end regions of the prongs.

2. Device according to claim 1, wherein the crosspiece and the legs are rigidly connected with one another and the legs are parallel to each other.

3. Device according to claim 1, wherein the legs are of different lengths.

4. Device according to claim 1, wherein the longitudinal recesses have a flat-rectangular cross section.

5. Device according to claim 4, wherein the longer cross-sectional dimension is perpendicular to the longitudinal extension of the handle device.

6. Device according to claim 1, wherein the end regions of the legs have the shape of an acorn through which passes the mouth of the longitudinal recess.

7. Device according to claim 1, wherein the end region of the legs is thinner in the transverse direction to the longitudinal extension of the crosspiece than it is in the perpendicular direction to same.

8. Device according to claim 1, wherein the longitudinal recesses are at least 1.5 cm, preferably at least 2 cm long+200%, −66%.

9. Device according to claim 1, wherein the legs are small tubes, and the longitudinal recesses are as long as the legs.

10. Device according to claim 1, wherein it is made of a single piece.

11. Device according to claims 1 or 2, wherein it is made of the same material overall.

12. Device according to claim 1, wherein the legs are 4 to 7 cm long.

13. Device according to claim 12, wherein the legs are 5 to 6.5 cm long.

14. Device according to claim 1, wherein the longitudinal recess in the free end region in one direction measures at least 4.5 mm, but not more than 5.5 mm.

15. Device according to claim 14, wherein the longitudinal recess in its free end region in a second direction perpendicular to the one direction measures at least 0.35 mm.

16. Device according to claim 15, wherein the amount is between 0.35 absolute and 5.5 mm minus the wall thickness of the legs in this region.

17. Device according to claim 1, wherein it has two median planes and it is symmetrical in relation to its two median planes.

* * * * *